United States Patent [19]

Brewer

[11] 4,307,994

[45] Dec. 29, 1981

[54] VARIABLE VANE POSITION ADJUSTER

[75] Inventor: Donald F. Brewer, Indianapolis, Ind.

[73] Assignee: General Motors Corporation, Detroit, Mich.

[21] Appl. No.: 84,787

[22] Filed: Oct. 15, 1979

[51] Int. Cl.[3] ..... F01D 17/16

[52] U.S. Cl. ..... 415/160

[58] Field of Search ..... 415/160, 161, 162, 163, 415/164

[56] References Cited

U.S. PATENT DOCUMENTS

| | | | |
|---|---|---|---|
| 2,651,492 | 9/1953 | Feilden . | |
| 2,671,634 | 3/1954 | Morley . | |
| 3,079,128 | 2/1963 | Burge . | |
| 3,367,628 | 2/1968 | Fitton . | |
| 3,954,349 | 5/1976 | Abild | 415/160 |
| 4,193,738 | 3/1980 | Landis et al. | 415/160 |
| 4,195,964 | 4/1980 | Kraft et al. | 415/160 |

*Primary Examiner*—Louis J. Casaregola

*Attorney, Agent, or Firm*—J. C. Evans

[57] ABSTRACT

A turbine vane adjustment assembly for calibrating the nozzle/throat width dimension between adjacent adjustable vanes in a nozzle vane ring assembly and for producing conjoint rotation of the individual vane following their calibration includes a vane stem that extends outwardly of a turbine case and further includes a motion converting sleeve in surrounding relationship thereto and coacting means between the sleeve and the vane stem that concurrently rotates both the sleeve and the stem and also provides relative axial movement of the sleeve with respect to the vane stem; the adjustment assembly further includes an actuator arm for rotating each of the vanes and means for connecting the actuator arm to the sleeve to cause angular positioning of the actuator arm to be directly transmitted to each of the vanes following calibration thereof. A calibration adjustment nut is located at a point accessible from externally of the turbine case and is associated with the sleeve and operative to axially position it on the vane stem and wherein coacting means on the sleeve and the actuator arm are responsive to axial positioning of the sleeve on the vane stem to rotate it relative to the actuator arm so that the vane stem can be prepositioned to selectively vary the throat width clearance between selected ones of adjacent nozzle vanes in the assembly.

3 Claims, 5 Drawing Figures

VARIABLE VANE POSITION ADJUSTER

The invention herein described was made in the course of work under a contract or subcontract thereunder with the Department of Defense.

This invention relates to turbine nozzle structures with variable vanes and fixed shroud structures to support the vane and more particularly to means for calibrating the position of individual nozzle vanes with respect to the shroud structures to calibrate throat width dimensions between the vanes without mechanically bending component parts of an actuator system which concurrently operates all of the vanes through alike angularly adjusted positions following calibration thereof.

Various proposals for variable stator vanes for turbo machines have been suggested including U.S. Pat. Nos. 2,651,492, issued Sept. 8, 1953, to Feilden for "Turbine;" 2,671,634, issued Mar. 9, 1954, to Morley for "Adjustable Stator Blade and Shroud Ring Arrangement For Axial Flow Turbines and Compressors;" 3,079,128, issued Feb. 26, 1963, to Burge for "Sealing and Securing Means for Turbomachine Blading" and 3,367,628, issued Feb. 6, 1968, Fitton for "Movable Vane Unit."

While the aforesaid arrangements are suitable for their intended purpose they do not have means associated therewith to produce presettable calibration of the throat width dimension between individual ones of a plurality of variable vanes in a variable turbine nozzle ring.

Accordingly, an object of the present invention is to improve variable turbine nozzle or other turbomachine variable components for use in high performance engines requiring close dimensional control of the throat width dimension for exhaust from the turbine nozzles by the provision therein of calibrating means to permit individual adjustment of the angular position of a vane with respect to an adjacent blade to control throat dimensions between the individual vanes without mechanically deforming component parts of an actuating mechanism for conjointly operating all of the vanes through like variably adjustable angular positions in response to engine control signals.

Still another object of the present invention is to provide an improved variable throat turbine nozzle assembly for use in high performance gas turbine engines including individual vane components thereon each associated with a vane stem mounted adjustment mechanism to vary the angular position between individual pairs of adjacent vanes so as to control the throat width dimension therebetween for precisely establishing exhaust flow areas from the turbine nozzle to maintain desired performance characteristics of the engine and to do so by means of an adjustment mechanism located exteriorly of the engine case and operative independently of an actuator mechanism for conjointly positioning of the vanes into variable angle control positions independently of adjustment of the throat width between individual ones of the vanes in the turbine nozzle vane assembly.

Still another object of the present invention is to provide an improved turbine vane assembly for adjusting the nozzle throat width dimensions between adjacent adjustable vanes in a nozzle vane ring assembly for a gas turbine engine each connected to an angularly adjusted vane; each of the vanes having a stem connected to an actuator system for concurrently adjusting each of the vanes to a variable angular position with respect to an axial annular flow path to control the angle of attack of nozzle exhaust flow with respect to the leading edge of turbine rotor blades and including adjustment means for calibrating each of the vanes into an angularly adjusted position with respect to other adjacent vanes to establish a preset adjusted throat width dimension between each of the vanes to maintain desired performance characteristics of the nozzle without mechanically deforming component parts of the actuator system.

Still another object of the present invention is to provide an improved turbine vane assembly for calibrating the nozzle throat dimension between adjacent adjustable vanes in a variably positioned nozzle vane ring assembly by the provision of a vane stem on each of the nozzle vanes that extends outwardly of a turbine case and including a motion converting sleeve telescoped thereover and coupled thereto by coacting means to produce concurrent rotation of the sleeve and the stem and allow for relative axial movement of the motion converting sleeve with respect to the vane stem; and further including an actuator arm rotating each of the vanes in response to engine command signals to control the angle of attack of exhaust flow from the nozzle vane ring assembly to the leading edge of turbine rotor blades and by the further provision of a calibration adjustment nut accessible from externally of the turbine case and operative to axially position the sleeve on the vane stem and to actuate means on the sleeve and actuator arm in response to axial positioning of the sleeve so as to rotate the vane stem relative to the actuator arm to permit preadjustment of the angular disposition of selected ones of the nozzle vanes in the nozzle vane ring assembly to calibrate throat width dimensions between adjacent nozzle vanes so as to establish a desired total nozzle throat flow area for maintaining nozzle flow efficiency during engine operation.

Further objects and advantages of the present invention will be apparent from the following description, reference being had to the accompanying drawings wherein a preferred embodiment of the present invention is clearly shown.

Figure 1:
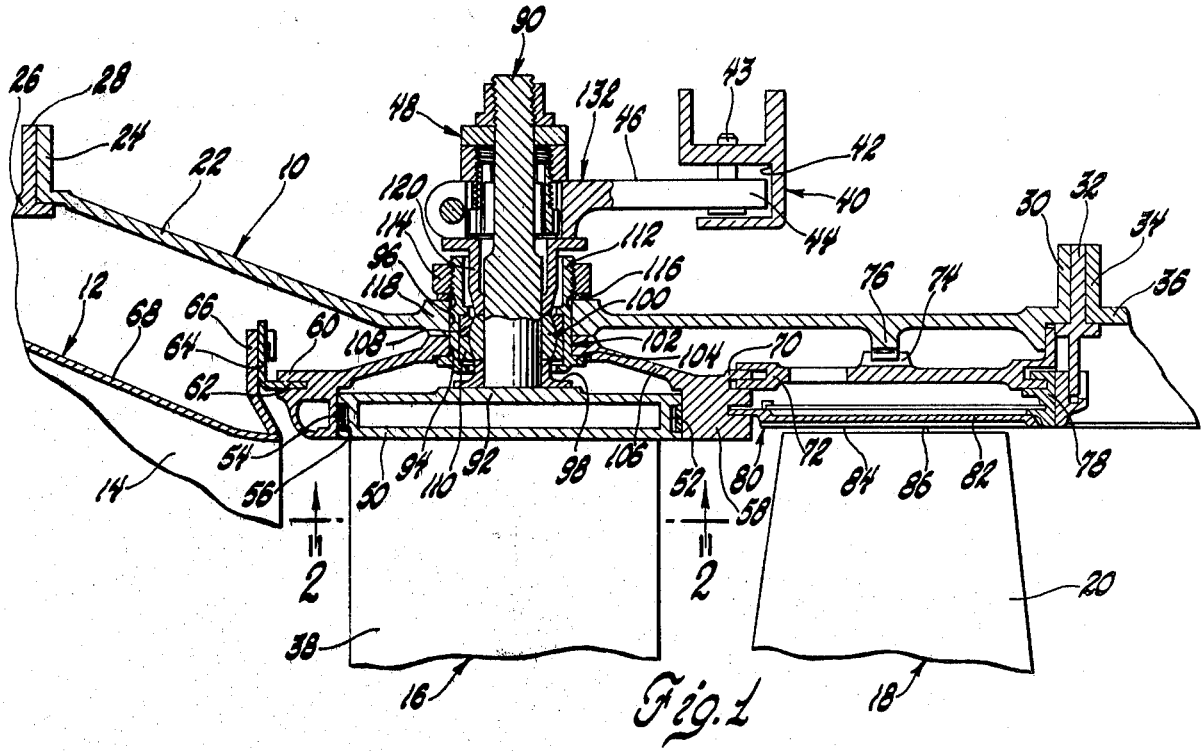
FIG. 1 is a fragmentary sectional view, with blade and vane components in elevation, showing an adjustable actuator for a turbine vane nozzle assembly constructed in accordance with the present invention.

Referring now to FIG. 1 a gas turbine engine hot section 10 is illustrated including a fragmentary portion of an outlet of a transition member 12 from a gas turbine engine combustor. It forms a passage 14 therethrough for directing high temperature motive fluid to a nozzle vane ring assembly 16 of the hot section. The nozzle vane ring assembly 16 is located upstream of a turbine rotor state 18 having a plurality of radially outwardly directed blades 20 thereon, one of which is shown in FIG. 1.

The hot section 10 includes an outer case 22 with a fore flange 24 thereon connected to an upstream turbine case 26 at an aft flange 28 thereon. The outer case 22 has an aft flange 30 thereon connected to an annular locater flange 32 thence to a flange 34 of a downstream outer case 36.

The nozzle vane ring assembly 16 more particularly includes a plurality of individual nozzle vanes 38 that are arranged to be variably positioned so as to vary the angle of attack of gas flow from the passage 14 to the turbine rotor stage 18 so as to vary the output from the turbine rotor stage 18. In order to accomplish this each of the vanes 38 is associated with an exteriorly located annular actuator ring 40 surrounding outer case 22. Ring 40 has a channel 42 therein connected by pins 43 to the ends 44 of a plurality of actuator arms 46, one such connection shown in FIG. 1. Each arm 46 is coupled to one of the vanes 38 by an actuation and adjustment mechanism 48 constructed in accordance with principles of the present invention.

In the illustrated arrangement, each of the vanes 38 is representatively shown as including a platform 50 of circular form including a peripheral groove 52 therein to receive a piston ring seal 54 that is biased into sliding sealing engagement with a circular wall 56 formed by spaced shroud members 58. Each member 58 is supported at a grooved front edge 60 thereon to a lip 62 on an L-shaped flange 64 that is interconnected to an annular flange 66 on the outer surface 68 of the transition member 12 to accommodate both radial and axial differential thermal growth between the outer wall 68 and the shroud members 58. The shroud members 58 are also connected at a grooved trailing edge portion 70 thereon to a support member 72 having a plurality of radially outwardly directed teeth 74 interlocked with the outer case 22 at stops 76 dependent therefrom. The support member 72 is thereby indexed against rotation with respect to the outer case 22. It also serves as a support for a radially outwardly directed flange 78 on a shroud assembly 80 including shroud segments 82 located radially outwardly so as to have the inner surface 84 thereon defining an annulus around the outer tips 86 of each of the blades 20 to prevent gas bypass.

All of the aforesaid component parts for aligning and supporting the turbine nozzle vanes and turbine rotor shroud segment with respect to the outer case 22 are representative of gas turbine engine hot section components that are improved by use of the nozzle vane actuator and adjustment mechanism 48 of the present invention.

Figure 2:
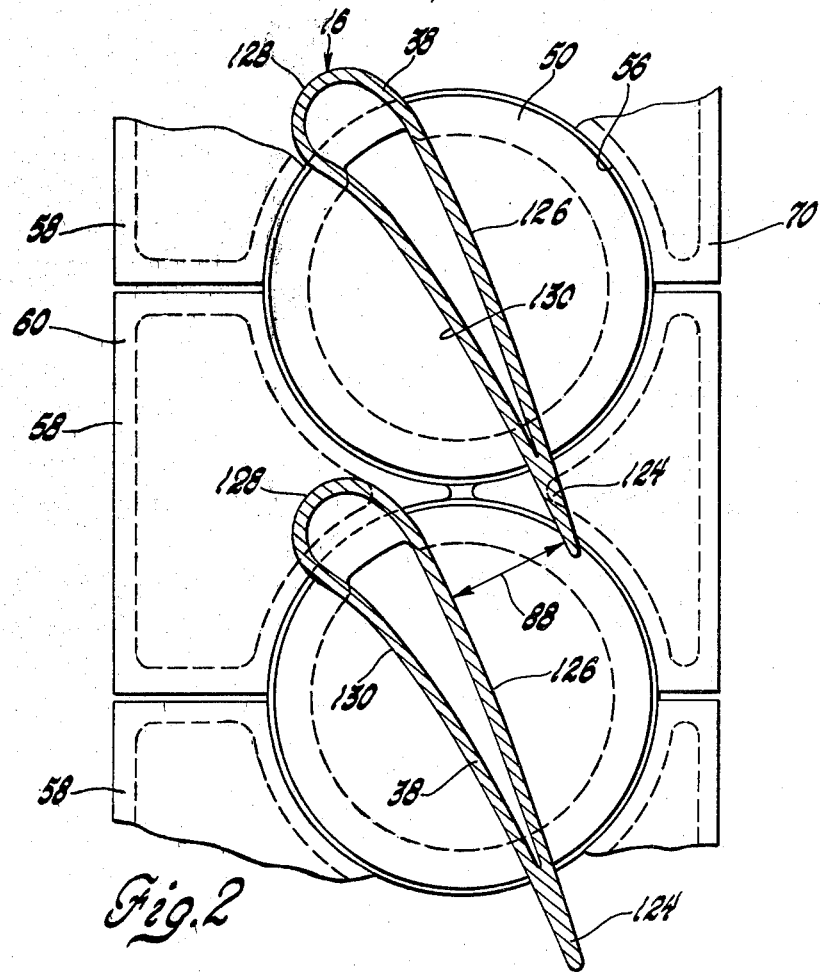
FIG. 2 is an enlarged, sectional view taken along the line 2—2 of FIG. 1 looking in the direction of the arrows.

Heretofore, variable vane nozzle assemblies in such structure have been coupled to an actuator ring such as shown at 40 in FIG. 1. Such rings are rotated by suitable hydraulic actuators in response to engine commmand signals to concurrently vary the adjustment angle of each of the individual nozzle vanes to a like amount. However, in high performance engines it is recognized that it is necessary to closely establish a predetermined throat width dimension as shown at 88 in FIG. 2 between each of the vanes 38 and to do so by angular preadjustment of each of the vanes 38 with respect to one another. Such precalibration of each of the individual vanes compensates for differences in manufacturing tolerances and accurately presets the throat dimensions between each of the vanes through at least part of their angular range of operation. In accordance with the principles of the present invention, to accomplish this objective, the actuator and adjustment mechanism 48 on each vane 38 includes a vane stem 90 connected at one end to the outer plate 92 of the platform 50. The opposite end of each stem 90 is directed through bores 94, 96 formed in the shroud member 58 and the outer turbine case 22, respectively. A flanged spacer ring 98 is fit over the vane stem 90 and is seated on the outer plate 92 to serve as a locator for a spherically surfaced sleeve 100 of a spherical joint 102 that accommodates differential thermal expansion between the component parts of the nozzle vane ring assembly 16 and the cooler temperature outer turbine case components such as outer turbine case 22.

The spherical joint 102 includes a flanged bearing cage 104 seated against the outer wall 106 of the shroud member 58. Cage 104 supports two spherically surfaced bearing members 108, 110 that supportingly receive the outer spherical surface of the sleeve 100. The upper end of the flanged bearing cage 104 has an externally threaded end 112 thereon engaged by a nut 114 seated against a lock washer 116 on a boss 118 around the bore 96 to hold the spherical joint 102 in place with respect to the outer case 22 and the outer wall 106.

Figure 3:
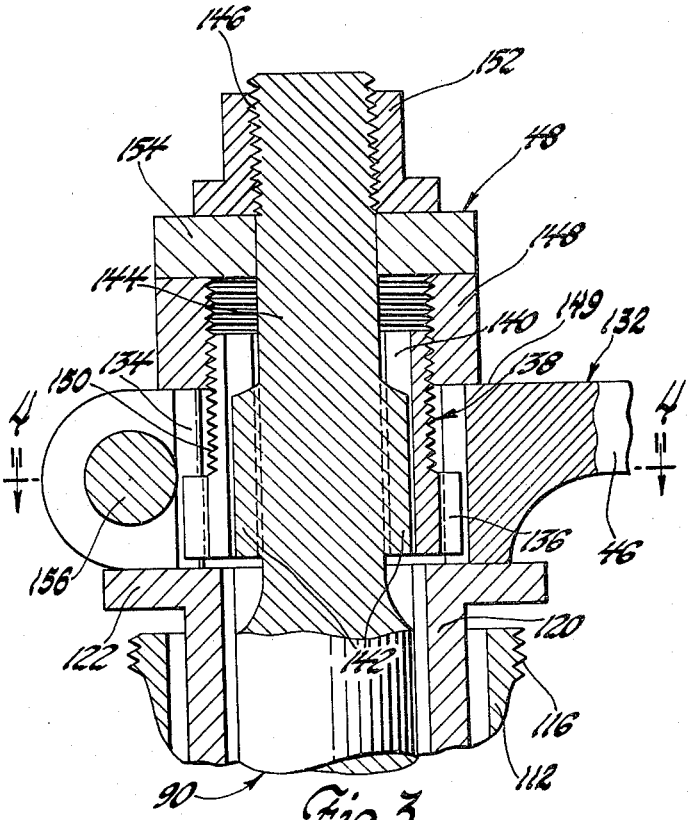
FIG. 3 is an enlarged longitudinal sectional view of a portion of the adjustable actuator in FIG. 1 located externally of the outer case of the turbine engine.
Figure 4:
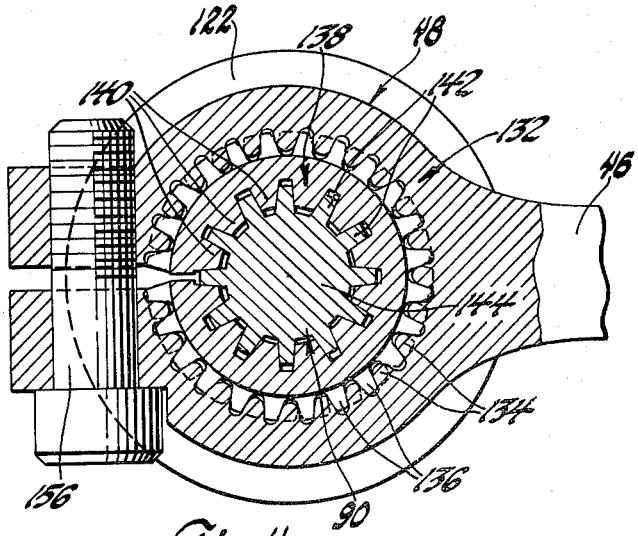
FIG. 4 is a cross sectional view taken along the line 4—4 of FIG. 3 looking in the direction of the arrows.
Figure 5:
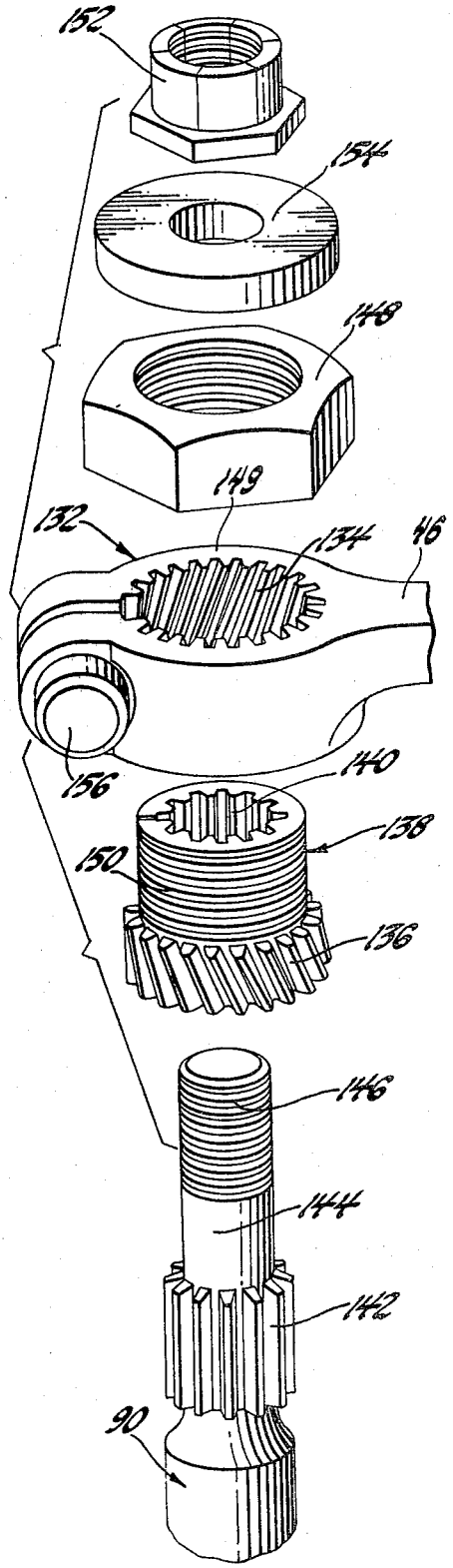
FIG. 5 is a perspective view of the component parts of the actuator assembly in FIGS. 3 and 4 shown in exploded relationship.

A spacer tube 120 is located around the stem 90 outboard of the joint 102 and includes an inboard edge thereon supported against the sleeve 100 to hold it in place. Tube 120 further includes a flange 122 serving as a platform for each actuator arm 46 as best shown in FIGS. 3 through 5.

The flange 122 also serves as a reference surface for the actuator and adjustment mechanism 48 in order that each of the vanes 38 can be initially preadjusted to establish an initial throat width dimension 88 between a trailing segment 124 on each of the vanes 38 and a convexly shaped surface 126 of an adjacent vane 38. Surface 126 connects the trailing segment 124 to a leading edge surface 128 which is connected by a concavely shaped surface 130 on the opposite side of each of the vanes 38.

Each mechanism 48 includes an expandable split ring 132 on the end of the actuator arm 46 with internal, helically formed spline teeth 134 mating with helically formed spline teeth 136 externally formed on the end of an adjustment sleeve 138. The adjustment sleeve 138 includes straight spline teeth 140 internally thereof located in axially slidable relationship with a plurality of radially outwardly directed straight spline teeth 142 on the outer surface of a reduced diameter portion 144 of the vane stem 90 as shown in FIG. 5. The reduced diameter portion 144 has an externally threaded upper end 146 thereon extending outwardly of an adjustment nut 148 in spaced relationship to internal threads thereon as shown in FIG. 3. The adjustment nut 148 rides on an outboard surface 149 of split ring 132 and thereby is located externally of the outer case 22 and outboard of the actuator arm 46 to be readily accessible for adjustment. Nut 148 is threadably connected to an upper externally threaded end 150 of the adjustment sleeve 138 and is operative to shift the adjustment sleeve 134 axially with respect to the stem 90 along the straight spline teeth 142. The adjust mechanism 48 is held in place by a lock nut 152 threadably received on the upper end 146 of stem 90 for holding a washer 154 against the outer end of the adjustment nut 148 to hold it against surface 149 as shown in FIG. 3.

The split ring 132 is fastened in place on the helical spline surface 136 of the sleeve 138 by clamp bolt 156.

In practicing the present invention, the aforedescribed parts are set to establish a desired throat dimention 88 by first loosening the clamp bolt 156. Then the adjustment nut 148 is rotated to axially shift the adjustment sleeve 138 on the straight splines 142 of the stem 90. Concurrently, the sleeve 138 will be rotated by the amount of the pitch of the helical spline teeth 136 on the sleeve and the helical spline teeth 134 on the actuator arm 46 thereby to preset the angular position of the stem 90 and the vane 38 connected thereto so as to preset the throat width dimensions 88 between the individual ones of the vanes to compensate for manufacturing tolerances and thereby assure nozzle throat flow areas to maintain desired nozzle performance characteristics.

Following precalibration adjustment of each of the individual vanes 38, the clamp bolts 156 are tightened to position the spline teeth 134 and 136 into a zero lash relationship thereby to produce a solid connection between the actuator arm 46 and the vane stem 90 via each mechanism 48. Thereafter all of the preadjusted vanes 38 can then be moved concurrently by rotation of the actuator ring 40 in response to a command signal from an engine controller.

While the embodiments of the present invention, as herein disclosed, constitute a preferred form, it is to be understood that other forms might be adopted.

The embodiments of the invention in which an exclusive property or privilege is claimed are defined as follows:

1. A turbine vane adjustment and actuation system for calibrating the nozzle/throat width dimensions between adjacent angularly adjustable nozzle vanes in a nozzle vane ring assembly and for controlling conjoint rotation of the individual vanes following calibration thereof comprising: a turbine case, a vane stem extending outwardly of said turbine case, an actuator arm for rotating each of said vanes following calibration thereof, means for connecting said actuator arm to said stem to cause angular positioning of said actuator arm to be directly transmitted to each of said vanes following calibration thereof, and adjustment means outboard of said turbine case disposed between said actuator arm and said vane stem including a manually actuated calibration means operative upon actuation to effect relative angular displacement between said vane stem and said actuator arm whereby said vane stem can be prepositioned without moving said actuator arm so as to calibrate throat width clearances between adjacent nozzle vanes thereby to pre-establish a desired nozzle/throat flow area for maintaining a desired operating turbine nozzle performance during its control during subsequent angular positioning of said vanes by said actuator arm.

2. A turbine vane adjustment and actuation system for calibrating the nozzle/throat width dimensions between adjacent angularly adjustable nozzle vanes in a nozzle vane ring assembly and for controlling rotation of the individual vanes following calibration thereof comprising: a turbine case, a vane stem extending outwardly of a turbine case, a motion converting means connected to said vane stem including an adjustment sleeve operative for concurrent rotation with said stem and for relative axial movement of said sleeve relative to said vane stem, an actuator arm for rotating each of said vanes following calibration thereof, means for connecting said actuator arm to said sleeve to cause angular positioning of said actuator arm to be directly transmitted to each of said vanes following calibration thereof, means including calibration adjustment operative to axially position said sleeve on said vane stem to rotate said vane stem relative to said actuator arm upon relative axial movement of said sleeve as produced by said calibration adjustment means whereby said vane stem can be prepositioned without moving said actuator arm so as to calibrate throat clearances between adjacent nozzle vanes thereby to pre-establish a desired nozzle/-throat flow area for maintaining a desired operating turbine nozzle performance during its control during subsequent angular positioning of said vanes by said actuator arms.

3. A turbine vane adjustment and actuation system for calibrating the nozzle/throat width dimensions between adjacent angularly adjustable nozzle vanes in a nozzle vane ring assembly and for controlling conjoint rotation of the individual vanes following calibration thereof comprising: a turbine case, a vane stem extending outwardly of said tubrine case, a motion converting sleeve surrounding said vane stem, first coacting means coupling said sleeve to said vane stem for concurrent rotation of said sleeve and said stem and for relative axial movement of said sleeve relative to said vane stem, an actuator arm for rotating each of said vanes following calibration thereof, means for connecting said actuator arm to said sleeve to cause angular positioning of said actuator arm to be directly transmitted to each of said vanes following calibration thereof, a calibration adjustment means accessible exteriorly of said turbine case and operative to axially position said sleeve on said vane stem, and second coacting means on said sleeve and said actuator arm responsive to the axial position of said sleeve on said vane stem to rotate said vane stem relative to said actuator arm upon relative axial movement of said sleeve produced by said calibration adjustment means whereby said vane stem can be prepositioned so as to calibrate throat width clearances between adjacent nozzle vanes thereby to pre-establish a desired nozzle/throat flow area for maintaining a desired turbine nozzle performance during its control during subsequent angular positioning of said vanes by said actuator arms.

* * * * *